United States Patent [19]

Forrester

[11] Patent Number: 4,600,080

[45] Date of Patent: Jul. 15, 1986

[54] THREE-LEGGED STEPLADDER

[76] Inventor: Charles R. Forrester, 204 N. Mendenhall St., Greensboro, N.C. 27401

[21] Appl. No.: 775,428

[22] Filed: Sep. 12, 1985

Related U.S. Application Data

[63] Continuation of Ser. No. 590,902, Mar. 19, 1984, abandoned.

[51] Int. Cl.[4] ..... E06C 1/14; E06C 1/393

[52] U.S. Cl. ..... 182/124; 182/126; 182/169

[58] Field of Search ..... 182/169, 165, 172, 170, 182/124, 125, 126

[56] References Cited

U.S. PATENT DOCUMENTS

| | | | |
|---|---|---|---|
| 947,409 | 1/1910 | Hudson | 182/166 |
| 1,184,432 | 5/1916 | Dueber | 182/166 |
| 3,356,180 | 12/1967 | Parry | 182/124 |
| 3,472,339 | 10/1969 | Herrera | 182/116 |

*Primary Examiner*—Reinaldo P. Machado

*Attorney, Agent, or Firm*—Charles R. Rhodes; Judith E. Garmon

[57] ABSTRACT

A tripod stepladder in which a bracing means includes a sleeve or collar that slides up and down the third or rear leg as the ladder is folded and unfolded. A pail shelf is pivotally attached to the third leg and locks the ladder in the open position, thereby preventing inadvertent closure of the ladder as long as the pail shelf is in the horizontal position.

4 Claims, 6 Drawing Figures

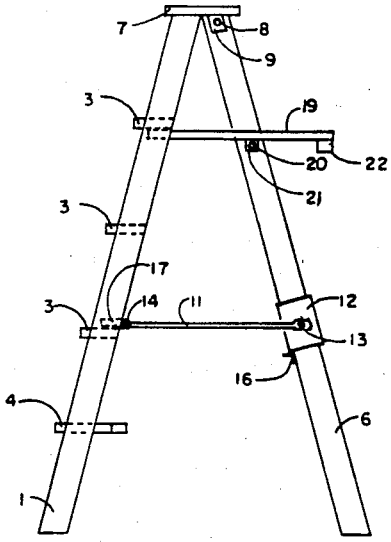
FIGURE I
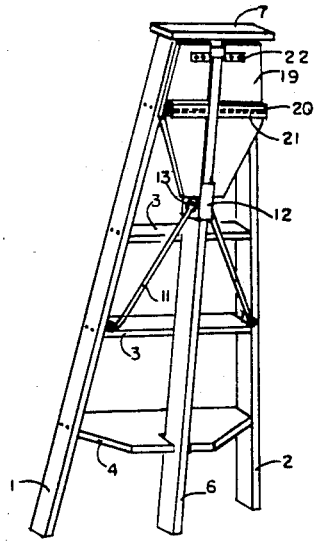
FIGURE II
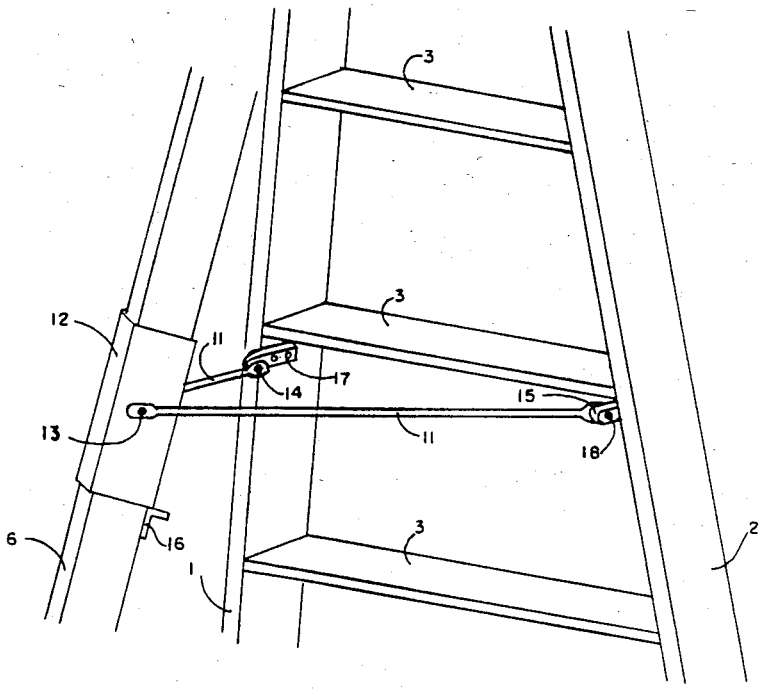
FIGURE III

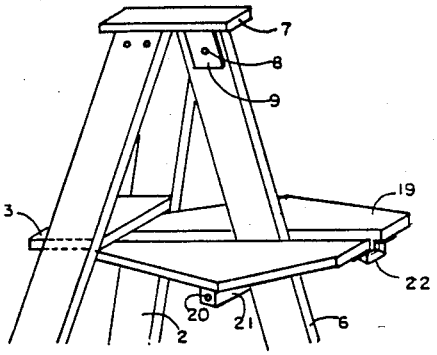
FIGURE IV
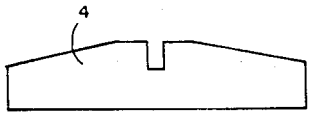
FIGURE V
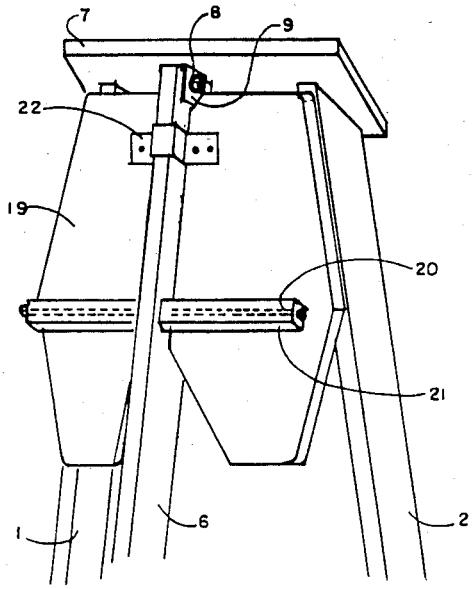
FIGURE VI

THREE-LEGGED STEPLADDER

REFERENCE TO RELATED APPLICATION

This application is a continuation of applicant's previously filed application Ser. No. 590,902, filed Mar. 19, 1984, now abandoned.

BACKGROUND AND SUMMARY OF THE PRESENT INVENTION

This invention relates to stepladders and more specifically to tripod or three-legged stepladders.

While stepladders have been in use for many years, they have traditionally been of the four-legged type. While four-legged support structures provide an adequate foundation, they must be used in conjunction with a level, horizontal support surface. Therefore, considerable problems exist when one attempts to utilize a stepladder on the ground or natural terrains, as for outside work.

There are very few attempts, known to applicant, to overcome this problem. Such attempts as are known are the approaches illustrated and described in U.S. Pat. Nos. 1,184,432 to Dueber; 3,356,180 to Parry; and 3,472,339 to Herrera. While these approaches generally disclose three-legged or tripod ladders, there are various undesirable characteristics in each that have been overcome by the present invention.

For example, in the Dueber patent, the guard or brace is not triangular, and therefore not as strong. Also, an elongated slot in which the guard B slides tends to weaken the rear leg, and the sides of the pail shelf do not diverge from the front rearwardly to prevent inadvertent folding or closure of the rear leg of the ladder. Thus if the notched corners slip loose the rear leg may inadvertently fold. In the Parry patent, there is actually disclosed a different type of stepladder, which is in reality more of a step stool and very limited in height. Further, there is no pail shelf at all and no means to prevent inadvertent folding of the ladder. The Herrera disclosure is directed to a stepladder that is placed into a lake or body of water for a fisherman to stand upon. It includes no triangular bracing for the legs, nor any pail shelf.

In the present invention there is provided a general purpose, tripod type stepladder which overcomes each of the aforesaid problems. Toward this end, a triangular bracing system utilizes a pair of straight or linear rods which connect a sleeve or collar that slides along the rear leg with each of the front legs or stiles. The steps between the stiles form the third leg of the bracing triangle. The rear leg is not slotted, notched, or weakened in any manner. The collar merely fits around the rear leg and slides up and down as the ladder is folded and unfolded.

The pail shelf is pivotally attached to the rear leg and formed of a pair of identically-shaped platform members which are separated or spaced apart to provide clearance for pivotal motion on either side of the rear leg. The rear portion of the platform members are connected by a rigid, U-shaped bracket while the front portions of the platform members remain spaced apart. The side edges of the platform members include forward portions thereof which diverge from front to rear. The diverging edges are of such dimension and configuration that when in the horizontal position, only the very forwardmost portion fits between the opposed stiles. The diverging configuration prevents forward movement of the pail shelf and thus inadvertent collapse or folding of the rear leg while the pail shelf is in the horizontal, pail-supporting configuration. Thus, the pail support serves as a safety device and actually forms a locking member to prevent inadvertent closure or folding of the ladder unless the operator removes any pails therefrom and positively folds the pail shelf to its vertical or closed position. Then, and only then can the rear leg of the stepladder be folded.

It is an object of the present invention to provide an improved general purpose tripod-type stepladder.

It is another object of the present invention to provide a tripod stepladder of the type described which includes an improved tripod bracing system.

It is a further object of the present invention to provide a tripod stepladder of the type described in which the pail shelf forms the locking member that prevents inadvertent closure or folding of the stepladder.

Other objects and a fuller understanding of the invention will become apparent from reading the following detailed description of a preferred embodiment, along with the accompanying drawings in which:

FIG. I is a side view of the stepladder of the present invention;

FIG. II is a rear perspective view illustrating the stepladder of the present invention in the folded configuration;

FIG. III is an enlarged rear perspective, with parts broken away, of a portion of the stepladder of the present invention illustrating the triangular bracing structure;

FIG. IV is an enlarged rear perspective, with parts broken away, of the upper portion of the stepladder of the present invention illustrating the pail shelf in the open position;

FIG. V is a plan view of the lowermost step of the stepladder of the present invention; and FIG. VI is an enlarged rear perspective, with parts broken away, of the upper portion of the stepladder of the present invention showing the pail shelf in the closed position.

DETAILED DESCRIPTION OF A PREFERRED EMBODIMENT

Turning now to the drawings, and particularly to FIGS. I and II, there is illustrated in its entirety the ladder of the present invention. A front pair of side legs or stiles 1,2 support a plurality of steps 3,4. Preferably the side stiles 1,2 diverge from top to bottom, so that when the ladder is erected, it generally forms a pyramid shape. Thus, step 4 is the longest and each of steps 3 are somewhat less in length. The lowermost step 4 also includes a slot or notch 5 in the rear edge thereof for compactly receiving rear leg 6 in the folded position (FIG. II).

A top platform 7 connects and secures the upper ends of side stiles 1,2. Rear leg 6 is pivotally attached to the upper platform 7 by means of a pin 8 which extends through a bracket 9 and an opening in the upper extremity of rear leg 6. Thus arranged, the rear leg 6 pivotally moves from the open "in use" position illustrated in FIG. I to the closed storage position illustrated in FIG. II.

A pair of elongated, straight or linear bracing rods 11 connect the rear leg 6 to the front legs 1,2 as hereinafter described. A tubular sleeve or collar 12, which is generally rectangular and slightly greater in cross-sectional dimension than the cross section of rear leg 6, is slidably mounted on rear leg 6. Bracing rods 11 are pivotally attached to either side of bracket 12 by means of attachment screws or rivets 13. Screws or rivets 13 do not extend through leg 6, merely through the wall of sleeve 12. The front ends of bracing rods 11 are pivotally attached to brackets 17,18 by pivot pins 14,15. A stop member 16 is secured to the front edge of rear leg 6 and defines the lower extent of movement of sleeve 12. So arranged, as the leg 6 is folded inwardly, sleeve 12 is caused to slide upwardly along leg 6 to the folded position shown in FIG. II. Conversely, when the leg 6 is unfolded, the sleeve or collar 12 slides downwardly along leg 6 to stop 16 which defines the open position (FIG. I).

Turning now to FIGS. IV and VI, there is illustrated the pail shelf 19 which is generally formed of two substantially identical shelf or platform members 30,31. Shelf members 30,31 form split halves which are assembled together to form the complete shelf 19. In order to assemble shelf portions 30,31, an elongated bearing block 21 is attached to the underside of portions 30,31 in the intermediate portion thereof. A pivot pin 20 extends through the bearing locks 21 and through an opening in leg 6 to pivotally attach members 30,31 thereto. A U-shaped bracket 22 is secured to the under portion of each shelf member 30,31 adjacent the rear edge thereof to secure the shelf portions in attached, spaced relation to each other. The distance between shelf portions 30,31 is defined by the U-shaped bracket and is approximately the width of leg member 6 with some additional room for clearance. Bracket 22, in addition to securing the shelf portions 30,31 in spaced arrangement, also serves as a stop for the upper pivoting movement of the shelf 19 in the storage position.

Each shelf portion 30,31 includes a lower or front side edge portion 32 which angles outwardly from the front edge 33 toward the rear thereof. The inner edges 34 of portions 31,32 also diverge from front to rear to provide clearance for the collar 12 in the closed position (See FIG. II). As illustrated in FIG. IV, when the ladder is opened to the "in use" position, the pail shelf 19 is lowered to a horizontal position. At this time, the front edges 33 underlie the uppermost step 3 (FIG. IV). The angle of the side edges 32 is such that near the front edge thereof the shelf 19 is slightly narrower than the dimension between side stiles 1,2. However, the width of the shelf 19 expands in a rearward direction, caused by the slant or taper of side edges 32, to such an extent that the width thereof is greater than the dimension between side stiles 1,2. Therefore, the rear leg 6 cannot be closed by pushing the pail shelf 19 forwardly, because the width thereof will not permit such movement. Thus, it is only after the pail shelf 19 has been pivoted to the position shown in FIG. VI that the closing or folding of the rear leg 6 of the ladder can occur.

The pail shelf 19 serves as a locking means for holding the ladder in the open position, so that it cannot inadvertently close. Further, when paint or other goods are resting on the pail shelf 19, gravity tends to maintain the pail shelf in the horizontal position until the paint or other articles deposited on the pail shelf are removed.

While a preferred embodiment of the invention has been described in detail hereinabove, it is obvious that various changes and modifications might be made without departing from the scope of the invention which is set forth in the accompanying claims.

What is claimed:

1. A stepladder of the tripod type comprising:

(a) a front pair of side legs or stiles supporting and connected by a plurality of steps or rungs, said side legs diverging slightly from top to bottom, and a top step or platform joining the upper ends of said side legs;

(b) a third leg pivotally attached at the upper end thereof to said top platform and movable between a closed storage position and an open "in use" position;

(c) a triangular bracing means connecting said front pair of side legs and said third leg, said bracing means comprising:

(i) a sleeve or collar surrounding the front, rear, and sides of said third leg in slidable relation thereto;

(ii) a first, straight, linearly extending rod or bar pivotally connecting one side of said sleeve with one of said front legs;

(iii) a second, straight, linearly extending rod or bar pivotally connecting the other side of said sleeve with the other of said front legs;

(iv) whereby a rigid, sturdy, triangular bracing system is formed by the front steps and the two straight rods which serve to steady the pair of side legs and resist lateral motion of the third leg when in the open position;

(d) a pail shelf pivotally connected to said third leg and movable between a vertical storage position and a horizontal pail supporting position in which the forward portion of said shelf underlies one of the uppermost of said steps or rungs.

2. The stepladder according to claim 1 wherein said pail shelf comprises:

(a) a pair of substantially identically shaped wooden platform members pivotally attached to and on either side of said third leg;

(b) a U-shaped connecting bracket attached to the rear portion of each of said wooden members to secure them in spaced arrangement, the space between said platform members being substantially equal to the thickness dimension of said rear leg;

(c) said platform members including opposed, outer and inner side edges, the forward portion of said side edges diverging from front to rear;

(d) the dimension and configuration of said outer side edges being such that at a first point where said pail shelf underlies one of said steps, the side edge dimensions are equal to or less than the distance between said side legs and at a point rearwardly of said first point the side edge dimensions are greater than the distance between said side legs;

(e) whereby said pail shelf prevents closure of said rear leg when said shelf is in the horizontal pail supporting position.

3. The stepladder according to claim 1 wherein the lowermost of said steps is notched in the rear edge there of to receive said third leg when moved to the folded storage position.

4. The stepladder according to claim 2 wherein said pail shelf further includes tapered side edges of such dimension and configuration as to prevent movement of said third leg from said open "in use" position toward said storage position while said pail shelf is in said horizontal pail supporting position.

* * * * *